US007623059B2

(12) United States Patent
Klein

(10) Patent No.: US 7,623,059 B2
(45) Date of Patent: Nov. 24, 2009

(54) DISRUPTIVE MEDIA DISPERSAL SYSTEM FOR AIRCRAFT

(75) Inventor: John Frederick Klein, Port Washington, NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 11/543,645

(22) Filed: Oct. 5, 2006

(65) Prior Publication Data

US 2009/0184859 A1 Jul. 23, 2009

(51) Int. Cl.
*H01Q 15/00* (2006.01)
*F42B 12/70* (2006.01)
*G01S 13/00* (2006.01)

(52) U.S. Cl. ..... 342/12; 342/5; 342/13; 89/1.11; 102/501; 102/504; 102/505

(58) Field of Classification Search ..... 244/3.1–3.3; 342/1–14, 175, 15–20; 102/351, 335–345, 102/501, 504, 505, 363–365; 89/1.11; 250/336.1, 250/338.1–353
See application file for complete search history.

(56) References Cited

U.S. PATENT DOCUMENTS

| | | | | | |
|---|---|---|---|---|---|
| 3,137,231 | A | * | 6/1964 | Johnson | 342/12 |
| 3,808,595 | A | * | 4/1974 | Coop et al. | 342/12 |
| 3,992,628 | A | | 11/1976 | Karney | |
| 4,130,059 | A | * | 12/1978 | Block et al. | 342/12 |
| 4,167,008 | A | * | 9/1979 | Blickenstaff | 342/12 |
| 4,286,498 | A | * | 9/1981 | Block et al. | 342/12 |
| 4,333,402 | A | * | 6/1982 | Landstrom et al. | 342/12 |
| 4,371,874 | A | * | 2/1983 | Bloom | 342/12 |
| 4,404,912 | A | * | 9/1983 | Sindermann | 342/12 |
| 4,600,642 | A | * | 7/1986 | Lodge et al. | 342/12 |
| 4,673,250 | A | | 6/1987 | Roberts et al. | |
| 4,796,536 | A | * | 1/1989 | Yu et al. | 342/12 |
| 4,852,453 | A | * | 8/1989 | Morin | 89/1.11 |
| 5,039,990 | A | * | 8/1991 | Stevens et al. | 342/12 |
| 5,049,883 | A | * | 9/1991 | Woodward | 342/12 |
| 5,255,125 | A | | 10/1993 | Hale et al. | |
| 5,404,243 | A | | 4/1995 | Garfinkle | |
| 6,021,008 | A | | 2/2000 | Leib | |
| 6,028,724 | A | | 2/2000 | Leib | |
| 6,352,031 | B1 | | 3/2002 | Barbaccia | |
| 6,785,032 | B1 | | 8/2004 | Le Mere | |

FOREIGN PATENT DOCUMENTS

| | | |
|---|---|---|
| GB | 2320316 A | 6/1998 |

* cited by examiner

*Primary Examiner*—Bernarr E Gregory
(74) *Attorney, Agent, or Firm*—Alan G. Towner, Esq.; Pietragallo Gordon Alfano Bosick & Raspanti, LLP

(57) ABSTRACT

A disruptive media dispersal system for aircraft which absorbs and scatters directed energy weapon beams such as tracking lasers and high energy lasers (HELs) is disclosed. The system may include laser detectors, laser beam propagation disruptive media and a dispersal system. When attacked by a directed energy weapon such as a laser, the laser detector system or vehicle operator deploys the disruptive media. The disruptive media is released by a feeder and dispersal system into the air in the path of the tracking and/or HEL weapon. For example, the dispersal system may be located onboard the aircraft near the front of the fuselage.

21 Claims, 3 Drawing Sheets

DISRUPTIVE MEDIA DISPERSAL SYSTEM FOR AIRCRAFT

FIELD OF THE INVENTION

The present invention relates to the protection of aircraft from directed energy weapons, and more specifically relates to a system for dispersing from an aircraft disruptive media which absorbs and scatters laser beams and other types of directed electromagnetic radiation.

BACKGROUND INFORMATION

The use of directed energy weapons such as laser beams and high power microwaves against aircraft represents a significant threat. It would be desirable to protect aircraft from such threats.

SUMMARY OF THE INVENTION

The present invention provides a disruptive media dispersal system for aircraft which absorbs and scatters directed energy weapon beams such as tracking lasers and high energy lasers (HELs). The system may include laser detectors, laser beam propagation disruptive media and a dispersal system. When attacked by a directed energy weapon such as a laser, the laser detector system or vehicle operator deploys the disruptive media. The disruptive media is released by a feeder and dispersal system into the air in the path of the tracking and/or HEL laser weapon. For example, the dispersal system may be located onboard the aircraft near the front of the fuselage.

An aspect of the present invention is to provide a disruptive media dispersal system for an aircraft. The system comprises a container mounted adjacent a front portion of the aircraft, disruptive media in the container capable of absorbing and/or scattering a directed energy beam, and an ejector for dispersing the disruptive media from the container to thereby protect the aircraft from the directed energy beam.

Another aspect of the present invention is to provide a method of dispersing disruptive media from an aircraft. The method comprises providing disruptive media in a container adjacent a front portion of the aircraft capable of absorbing and/or scattering a directed energy beam, and dispersing the disruptive media from the container to thereby protect the aircraft from the directed energy beam.

These and other aspects of the present invention will be more apparent from the following description.

BRIEF DESCRIPTION OF THE DRAWINGS

FIG. 3 shows a laser-damaged surface. FIG. 4 shows an undamaged surface resulting from the use of a disruptive medium to absorb and scatter laser beam energy in accordance with an embodiment of the present invention. FIG. 5 shows a laser-damaged surface after the laser disruptive medium is no longer used to protect the surface.

DETAILED DESCRIPTION

Figure 1:
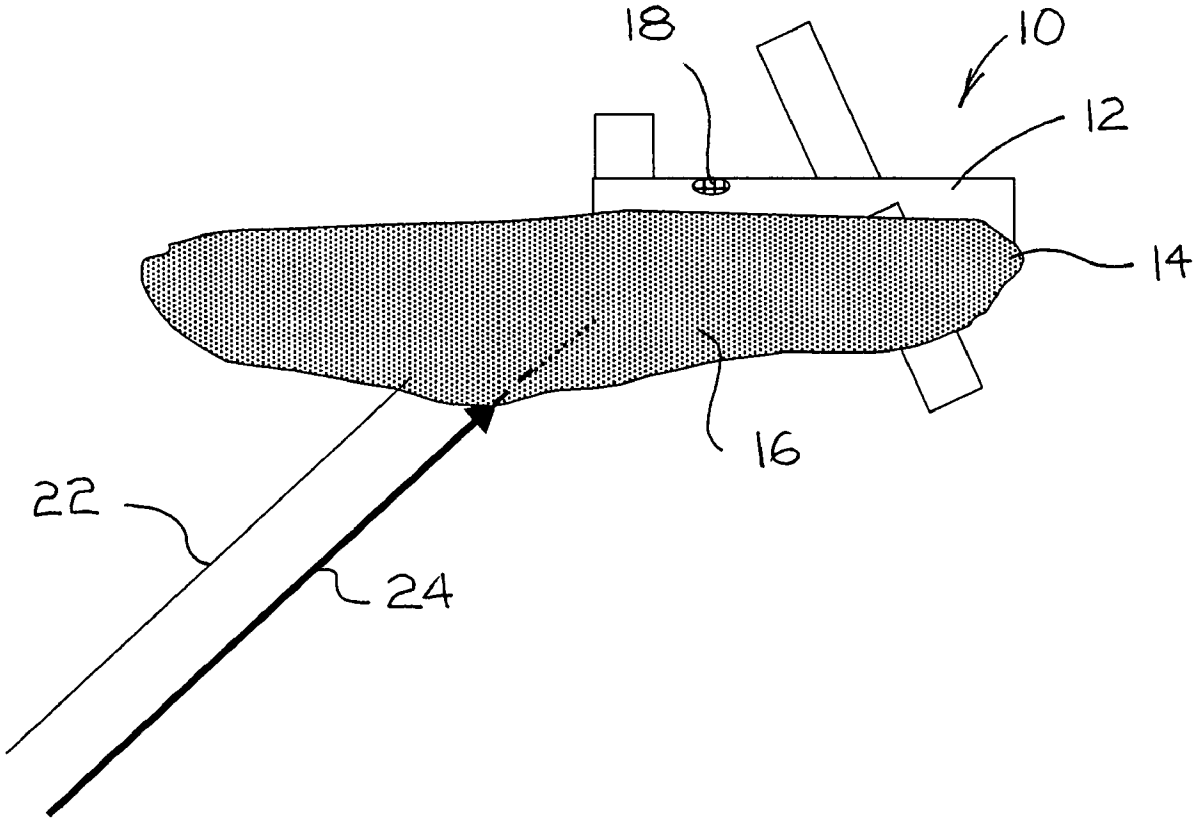
FIG. 1 is a partially schematic illustration of a laser beam disruption system used on an aircraft in accordance with an embodiment of the present invention.

FIG. 1 schematically illustrates a disruptive media dispersal system for an aircraft 10. The aircraft 10 includes a fuselage 12 having a front end 14 from which a disruptive media 16 is dispersed. The disruptive media 16 absorbs and/or scatters directed energy beams such as tracking lasers, high energy lasers, high power microwaves and the like. For example, the disruptive media may comprise powder such as carbon black or any other material capable of absorbing or scattering directed energy beams. When carbon black or other powders are used as the disruptive media, they are typically stored on or in the aircraft in powder form, and are dispersed from the aircraft in the powder form. Alternatively, the disruptive media may be stored and deployed from another location, such as from another aircraft, unmanned aerial vehicle or missile. A gas such as air may be mixed with the powder to aid dispersion. The disruptive media is typically dispersed at a temperature approximating the ambient temperature of the aircraft, i.e., the temperature inside or outside the aircraft, rather than at significantly elevated temperatures.

As shown in FIG. 1, a sensor 18, such as a conventional laser sensor, may be mounted on the aircraft 10 in order to detect incoming beams such as interrogation or tracking laser beams and/or high intensity laser beams. When such an incoming directed energy beam is detected, standard control hardware and associated software may be used to initiate dispersion of the disruptive media 16 from the front 14 of the aircraft 10, or to alert an operator to manually initiate dispersion of the media. FIG. 1 illustrates both a tracking laser beam 22 and a high energy laser beam 24 which are directed toward the aircraft 10. Due to the absorbing and scattering characteristics of the disruptive media 16, both laser beams 22 and 24 do not reach the aircraft 10, thereby preventing damage to the aircraft.

The dispersion of the disruptive media 16 into the laser paths 22 and 24 has three primary effects. The first effect is to disrupt the tracking and aiming laser 22 for the laser system. The laser beam 22 must be precisely aimed at the surface of the aircraft 10, and the surface heating point tracked to maintain continuous local heating. If the laser heating location is not maintained for sufficient time, such as a few seconds, the laser will not achieve damage. Disruption of the tracking laser 22 by the dispersed media 16 will disengage the tracking laser 22, causing disruption of the heating. The second effect is on the HEL beam 24, which is absorbed by the disruptive media 16 to prevent energy from reaching the aircraft structure surface 10 with sufficient intensity to damage the structure. Greater than 99 or even 99.9% disruption/absorption and corresponding elimination of drilling laser effects on structural surfaces may be achieved. A third effect may be the creation of a hot spot in the field of view of the tracking laser 22, overwhelming its sensors and blinding it.

A method to protect aircraft from laser DEW was demonstrated in the laboratory on a bench scale. A YAG:NDS+, 1.06-micron laser used for machining and drilling was applied for the demonstration. A test apparatus including test chamber, disruptive media feeder, and HEPA vacuum was assembled.

Figure 2:
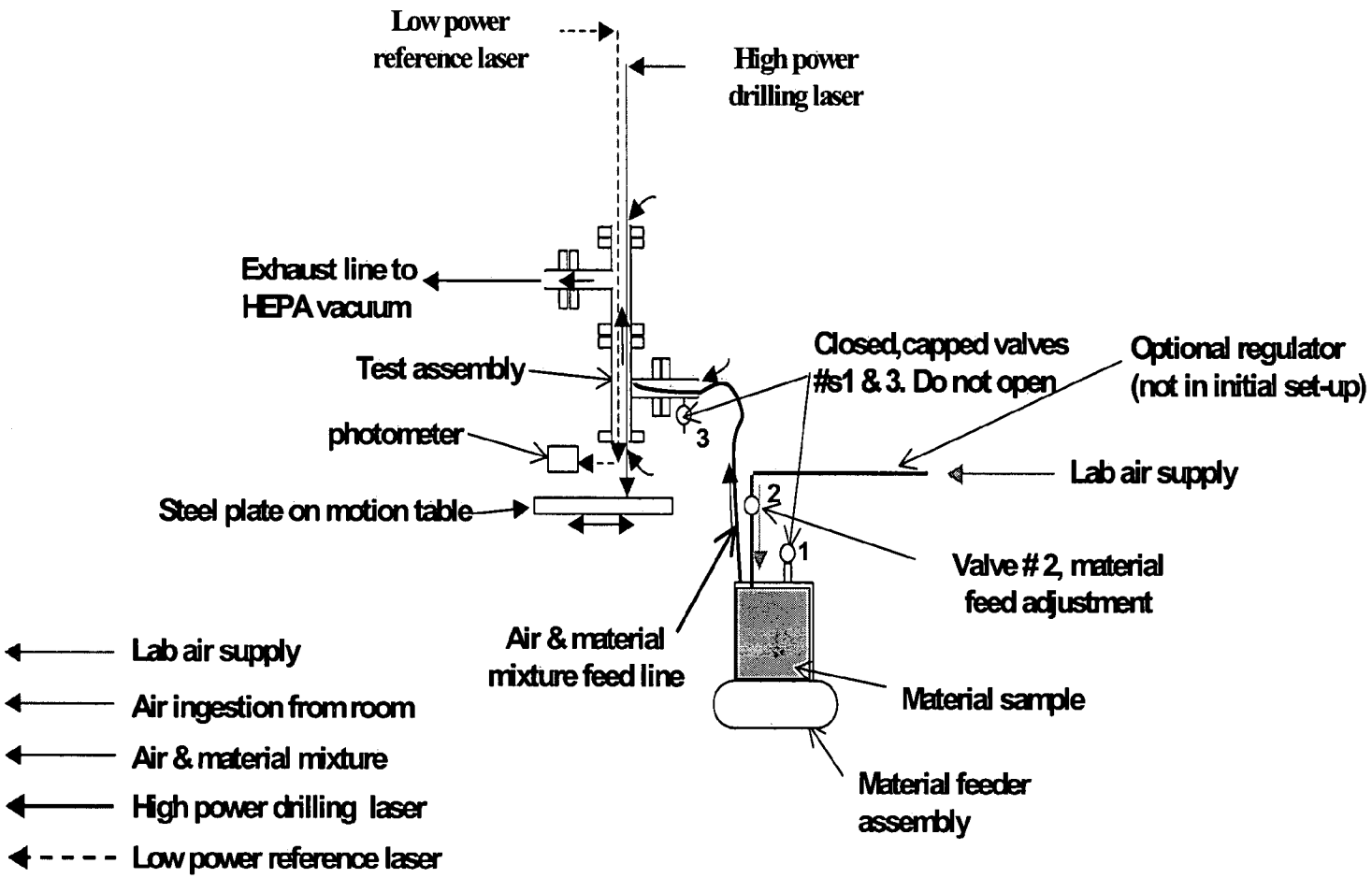
FIG. 2 is a partially schematic block diagram of a laser beam disruption test system.

FIG. 2 is a block diagram of the bench scale demonstration system. Air was drawn from the room through the test assembly by a vacuum (upper left side). Air is pulled into the apparatus, from the room, through the three openings to the room: top, bottom and lower right side. The test region is the vertical section between the two horizontal tubes. The drilling laser is fired through the test region. After passing through the test region the laser illuminates sample coupons mounted on a motion table. FIG. 2 indicates the path of the drilling laser as well as a reference laser. Laser beam attenuation was determined using the reference laser. Reference beam intensity, after passing through the test section was measured using a photo detector.

For the demonstration tests, the YAG laser was set for three levels of operation, which made a visible mark on a steel test sample. Each test consisted of three steps at the same laser power: (1) fire laser through test section burning a mark on the surface of a steel sample coupon before laser beam propagation disruption; (2) fire the laser through test section with the disruptive media in the test section; and (3) fire laser through test section burning a mark on the surface of a steel sample coupon after laser beam propagation disruption. Step 3 verifies that the laser had not changed.

Reference beam intensity was measured for each of the three test steps. During test step 2, disruptive media was introduced into the lower right horizontal leg of the test assembly. The media was drawn upward through the test section and out into the vacuum leg. Media was fed using a feeder. There are many potential disruptive media, which could be used to absorb/scatter the laser beams. For these tests carbon black powder was used as the disruptive media.

Marking a steel coupon surface is intended as an indication that the laser is at a power intensity that could damage an aircraft structure. At all three laser power levels the disruptive media prevented any mark being made on the sample surface. All three sets of before and after samples showed marks on the surface by the laser, verifying before and after performance.

Figure 5:
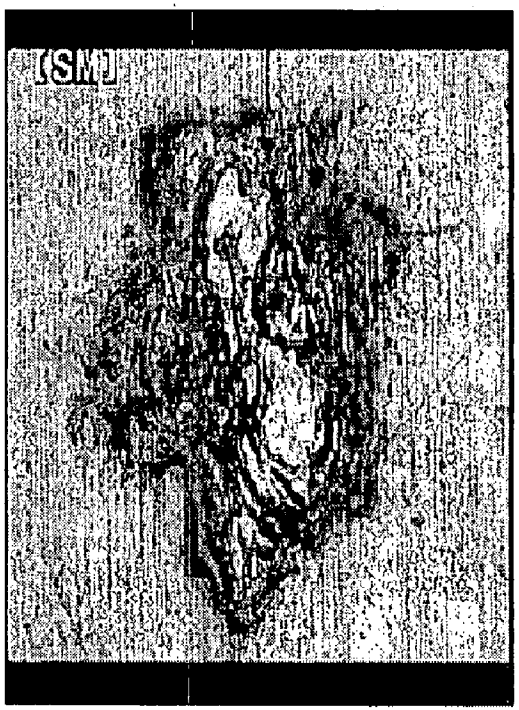
FIGS. 3-5 are photographs of a steel surface, showing the results of laser beam disruption tests.
Figure 4:
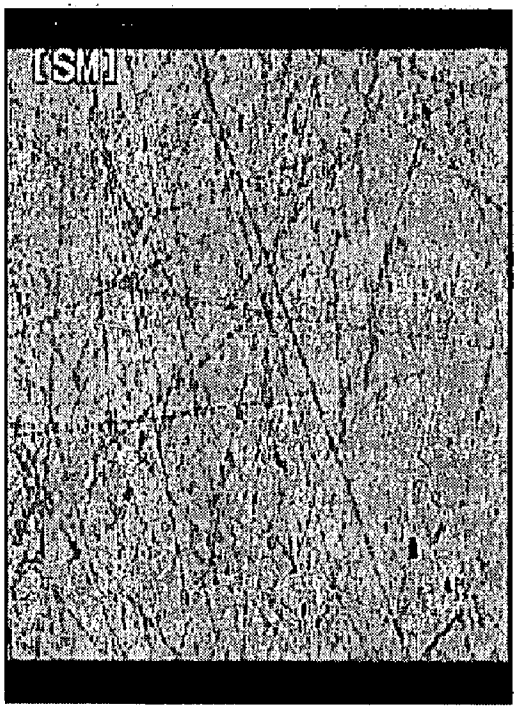
Figure 3:
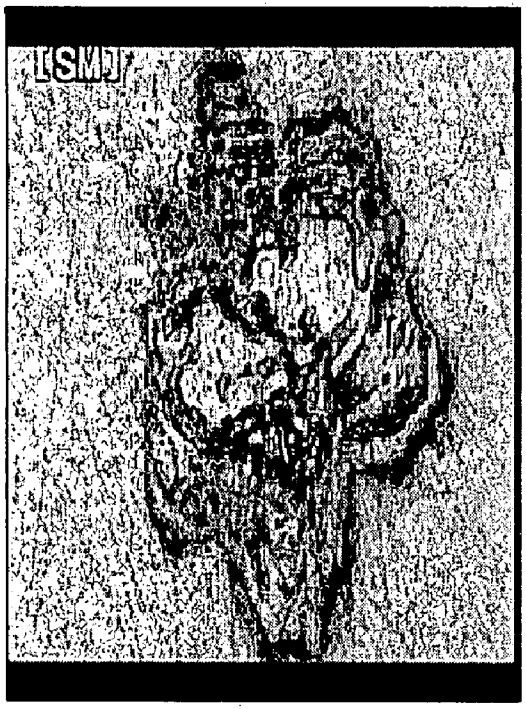

FIGS. 3-5 are photographs taken at the highest laser power level. FIG. 3 is a photograph of the mark made by the laser on a steel plate before beam disruption (step 1). FIG. 4 is a photograph of the plate when the laser was fired and the beam disrupted/absorbed (step 2). No mark was made at all. During step 2, reference laser transmission was reduced to less than 0.01% of undisrupted beam. FIG. 5 is a photograph of the mark made by the laser on a steel plate after the beam disruption was turned off (step 3). FIG. 5 serves to verify that the laser was still capable of making a similar mark on a plate after the beam was disrupted.

This test demonstrates the disruption of a laser with sufficient power density damage steel. During disruption no damage was done to the steel test coupons. Although the absolute power of the drilling laser is low compared to an HEL weapon, the drilling laser local heat flux is sufficient to damage/remove material. When installed on an aircraft, it may be desirable to utilize a more compact dispersal system than used in the test demonstration.

Whereas particular embodiments of this invention have been described above for purposes of illustration, it will be evident to those skilled in the art that numerous variations of the details of the present invention may be made without departing from the invention as defined in the appended claims.

The invention claimed is:

1. A disruptive media dispersal system for an aircraft comprising:

disruptive media in a container mounted on the aircraft, wherein the disruptive media consists essentially of carbon black powder for absorbing a directed energy beam, scattering the directed energy beam, or absorbing and scattering the directed energy beam when dispersed from the container outside of the aircraft; and an ejector for dispersing the disruptive media from the container to thereby protect the aircraft from the directed energy beam.

2. The disruptive media dispersal system of claim 1, wherein the container is mounted adjacent a front portion of the aircraft.

3. The disruptive media dispersal system of claim 2, wherein the disruptive media is dispersed at a temperature substantially equal to an ambient temperature of the aircraft.

4. The disruptive media dispersal system of claim 2, further comprising means for mixing the disruptive media with gas prior to the dispersion of the disruptive media.

5. The disruptive media dispersal system of claim 4, wherein the gas is injected into the container.

6. The disruptive media dispersal system of claim 4, wherein the gas comprises air.

7. The disruptive media dispersal system of claim 2, further comprising a sensor for detecting the directed energy beam.

8. The disruptive media dispersal system of claim 2, wherein the directed energy beam is a laser beam.

9. The disruptive media dispersal system of claim 8, wherein the laser beam is from a tracking laser.

10. The disruptive media dispersal system of claim 8, wherein the laser beam is from a high energy laser.

11. The disruptive media dispersal system of claim 2, wherein the directed energy beam is a microwave beam.

12. A method of dispersing disruptive media from an aircraft, the method comprising:

providing disruptive media in a container capable of absorbing a directed energy beam, scattering the directed energy beam, or absorbing and scattering the directed energy beam, wherein the directed energy beam is a laser beam; and dispersing the disruptive media from the container to thereby protect the aircraft from the directed energy beam, wherein the disruptive media is dispersed at a temperature substantially equal to an ambient temperature of the aircraft.

13. The method of claim 12, wherein the container is located adjacent a front portion of the aircraft.

14. The method of claim 13, wherein the disruptive media is stored and dispersed from the container in the form of a powder.

15. The method of claim 14, wherein the disruptive media comprises carbon black.

16. The method of claim 14, further comprising mixing the disruptive media with gas prior to the dispersion of the disruptive media.

17. The method of claim 16, wherein the gas is injected into the container.

18. The method of claim 16, wherein the gas comprises air.

19. The method of claim 13, further comprising sensing the directed energy beam.

20. The method of claim 13, wherein the laser beam is from a tracking laser.

21. The method of claim 13, wherein the laser beam is from a high energy laser.

* * * * *